US009421683B2

(12) United States Patent
Savarino

(10) Patent No.: US 9,421,683 B2
(45) Date of Patent: Aug. 23, 2016

(54) COIL SPRING CONNECTOR LOOP HANDLE

(71) Applicant: Balanced Body, Inc., Sacramento, CA (US)

(72) Inventor: Christoper J. Savarino, Sacramento, CA (US)

(73) Assignee: Balanced Body, Inc., Sacramento, CA (US)

( * ) Notice: Subject to any disclaimer, the term of this patent is extended or adjusted under 35 U.S.C. 154(b) by 152 days.

(21) Appl. No.: 14/071,496

(22) Filed: Nov. 4, 2013

(65) Prior Publication Data

US 2014/0059807 A1 Mar. 6, 2014

Related U.S. Application Data

(62) Division of application No. 12/915,488, filed on Oct. 29, 2010, now Pat. No. 8,602,950.

(51) Int. Cl.

| | |
|---|---|
| ***A63B 21/02*** | (2006.01) |
| ***B25G 1/10*** | (2006.01) |
| ***A63B 21/04*** | (2006.01) |
| ***A63B 21/055*** | (2006.01) |

(52) U.S. Cl.

CPC ..... *B25G 1/10* (2013.01); *A63B 21/023* (2013.01); *A63B 21/0407* (2013.01); *A63B 21/055* (2013.01); *Y10T 16/469* (2015.01)

(58) Field of Classification Search

CPC ..... A63B 21/023; A63B 21/0407; A63B 21/055; A63B 21/02; A63B 21/025; A63B 21/0442; A63B 21/0557; B25G 1/10; B25G 1/102; Y10T 16/469; Y10T 16/476; Y10T 24/4755; Y10T 24/4764; Y10T 403/453; Y10T 403/459; F16B 47/00; F16F 1/12; F16F 1/125; F16F 1/128

USPC ..... 482/26–29, 121, 122, 127; 267/73, 74, 267/166.1, 179; 16/72, 75, 76, 428; 24/115 K, 265 H, 300, 301; 403/120, 403/166, 229, 304; 248/205.6, 362, 537, 248/683; 446/220

See application file for complete search history.

(56) References Cited

U.S. PATENT DOCUMENTS

| | | | | |
|---|---|---|---|---|
| 972,284 | A | 10/1910 | Storey | |
| 1,759,719 | A | 5/1930 | Spino et al. | |
| 1,939,968 | A * | 12/1933 | Frei, Jr. | E01F 9/017 116/63 R |
| 2,488,534 | A | 11/1949 | Hagerman | |
| 3,009,594 | A * | 11/1961 | Anson | B65D 47/121 215/228 |
| 3,528,656 | A * | 9/1970 | Haanen | 482/139 |

(Continued)

FOREIGN PATENT DOCUMENTS

| | | | |
|---|---|---|---|
| FR | 2605521 | A | 4/1988 |

*Primary Examiner* — Loan H Thanh
*Assistant Examiner* — Gregory Winter
(74) *Attorney, Agent, or Firm* — Greenberg Traurig, LLP

(57) ABSTRACT

A spring connector that includes a loop is used in an exercise apparatus that has one or more springs fastened between a movable member and a stationary member. The connector of this disclosure includes a handle to aid a user to fasten one end of a spring to a stationary hook or post. The handle is a solid body generally symmetrical about a central axis, and has a large diameter base end and an opposite small diameter end, the base end having a transverse slot therein intersecting an axial bore through the solid body. The transverse slot has a curved bottom shape receiving a bottom portion of the connector loop. A user can grip the handle and install the loop over a hook or post without putting a finger in the loop.

10 Claims, 6 Drawing Sheets

(56) References Cited

U.S. PATENT DOCUMENTS 3,680,858 A * 8/1972 Ossenkop et al. ..... 482/126
4,133,362 A * 1/1979 Kolloch et al. ..... 30/167
4,162,063 A 7/1979 Nissen et al.
4,251,071 A 2/1981 Norton
4,452,444 A 6/1984 Schulze, Jr.
4,489,937 A * 12/1984 Kong ..... 482/126
4,834,571 A * 5/1989 Greenburg ..... F16B 2/06 174/84 S
4,843,905 A * 7/1989 Jean ..... 74/551.9
4,867,444 A 9/1989 Castillo
D328,033 S * 7/1992 DiGuiseppi ..... D9/435
5,160,811 A * 11/1992 Ritzmann ..... F16L 3/015 138/121
5,230,679 A 7/1993 Olsen
5,507,712 A 4/1996 Chang
5,557,832 A * 9/1996 Vanden Brook ..... 29/243.56
D386,114 S * 11/1997 Carson ..... D11/143
5,690,598 A 11/1997 Liang
5,762,344 A * 6/1998 Einvall ..... 279/96
5,797,165 A * 8/1998 Armbrust ..... 16/430
5,823,077 A * 10/1998 Macor ..... 81/177.1
5,848,453 A * 12/1998 Racodon ..... 16/431
5,873,148 A * 2/1999 Arnold ..... 16/430
5,950,280 A * 9/1999 Taylor ..... 16/422
6,015,371 A * 1/2000 Davitt ..... 482/129
6,042,155 A * 3/2000 Lockwood ..... F16L 11/18 138/120
6,237,192 B1 * 5/2001 Garrison et al. ..... 16/422
6,253,712 B1 * 7/2001 Johnson ..... A01K 15/025 119/452
6,345,583 B1 2/2002 Thackston et al.
6,408,888 B1 * 6/2002 Baumer ..... F16G 13/16 138/120
6,575,654 B2 * 6/2003 Wentworth ..... H02G 3/0468 138/120
7,160,232 B2 1/2007 Barnard et al.
7,228,600 B1 6/2007 Selby et al.
7,533,906 B2 * 5/2009 Luettgen ..... H01R 35/00 285/146.1
7,540,070 B1 6/2009 Selby
7,634,874 B2 * 12/2009 Lucas ..... E04H 4/082 52/108
7,797,880 B1 * 9/2010 Kamau ..... A01G 9/02 47/66.1
7,896,307 B2 * 3/2011 Berg ..... G09F 19/22 248/346.01
2002/0072455 A1 6/2002 Akins
2005/0113220 A1 5/2005 Dovner et al.
2005/0113225 A1 5/2005 Dovner et al.
2005/0176562 A1 8/2005 Huang
2007/0173386 A1 7/2007 Wang
2007/0209161 A1 * 9/2007 Neering et al. ..... 16/422
2009/0134559 A1 5/2009 Akahori
2010/0095536 A1 * 4/2010 Lien ..... 30/366
2011/0088215 A1 * 4/2011 Vera ..... 16/110.1
2012/0167348 A1 * 7/2012 Adams ..... 16/426

* cited by examiner

COIL SPRING CONNECTOR LOOP HANDLE

CROSS REFERENCE TO RELATED APPLICATIONS

This application is a divisional of U.S. patent application Ser. No. 12/915,488, filed Oct. 29, 2010, the contents of which is hereby incorporated by reference in its entirety.

BACKGROUND OF THE DISCLOSURE

1. Field of the Disclosure

This disclosure generally relates to resistance based exercise equipment and more particularly to a spring connector for connecting a coil spring to or between components in a spring biased resistance exercise machine such as in a Pilates chair or reformer exercise apparatus.

2. Description of Related Art

Today, many types of exercise devices are available and used for fitness and/or medical reasons to burn off undesired calories, to improve cardiovascular ability, to tone or strengthen muscles, or to improve flexibility, balance, posture, etc. No matter what the desired end goal of a user of exercise equipment may be, almost all types of exercise equipment aid the user to achieve his or her desired goal by exerting some form of adequate and effective resistance against repeated bodily movements of the user.

Many of these exercise devices utilize elastic resistance members such as coil springs. A hook or closed loop (eye) is often used to connect at least one of the two ends of the coil spring (or generally a force resisting mechanism) between a movable and a fixed location on the exercise equipment.

A reformer is one such exercise device. A reformer is basically a rectangular frame that sits on a floor and constitutes or carries a pair of stationary parallel rails or tracks. A movable carriage for supporting a user's body is mounted on the rails for movement toward and away from one end, the foot end, of the frame. The carriage is typically elastically biased toward the foot end of the frame by one or more coil springs having one end attached to the carriage and the other to a hook or post on an anchor bar near the foot end of the frame.

Each coil spring has a generally cylindrical spiral outer shape, with tapered coil turns at each end. One end of each coil spring has a bent rod connector in the form of a hook or eye. The other end of each coil spring typically also has a bent rod hook that must be inserted into the eye of an eyebolt fastened to an anchor point. Alternatively one end has a hook and the other end has a bent rod connector forming a closed loop or eye that a user grasps and fastens to a corresponding hook or post on the exercise equipment.

The connector having an eye must be grasped by a user and placed over a post, hook or pin to fasten that end connector in place on an anchor bar. Often a user will simply hook his or her finger through the eye and pull the eye onto the post or hook. Sometimes this manipulation may involve some stretching of the spring in order to fit the eye onto the post. In this situation, there is a potential for one of the user's fingers to be caught or pinched between the eye and post during the attaching process. Thus there is a need for a device that a user can grasp to accurately connect the eye of the connector securely to the hook or post without exposing the user's fingers to a potential pinching situation.

SUMMARY OF THE DISCLOSURE

The present disclosure addresses this need. One embodiment of the present disclosure is a solid handle body that is adapted to be installed on the base of the connector loop between the spring and the loop during assembly of the spring and its end connectors. Another embodiment of the present disclosure is a polymer handle body that is adapted to be installed on the base of the connector loop between the spring and the loop in a previously assembled spring assembly. In both embodiments, a user simply grasps the handle to position the loop of the connector onto a stationary hook or post without putting his or her finger inside the loop.

A spring connector is typically carried in each end of a coil spring. The spring connector is an elongated connecting member having a head end and a foot end, a stopper body adapted to fit within the end of the coil spring and having an axial bore through which the foot end of the connecting member extends. A washer disc is positioned on the connecting member between the stopper body and a deformed section of the connecting member near the foot end. This deformed section retains the washer and the stopper body on the connecting member. The head end of the connector may be a closed loop or a hook.

In the case of a closed loop, first the head end is bent to form the closed loop and then a solid polymer handle body is slipped onto the foot end of the connecting member. The handle body is then pushed onto and preferably fastened over a base portion of the loop. The polymer stopper body and washer are then installed and the foot end is deformed to lock the washer and polymer stopper body thereon. The end coils of the coil spring are then telescoped over the connector deformed end, washer, and polymer stopper body. The end coils are then crimped or compressed to reduce their diameter. This results in an interference fit between the stopper body and the reduced diameter end coils of the coil spring that retains the connecting member within the end of the coil spring. The other end of the coil spring is assembled in a similar manner except, that if a hook is formed on the head end of the connector, no handle body is preferably installed.

The handle body is a solid body, preferably made of a polymer such as nylon, although any other suitable material may be used, such as a composite or metal, that has a generally truncated conical shape symmetrical about its central axis. Preferably the outer surface shape further is a concave truncated cone, with its larger diameter base portion configured to face the connector loop when installed on a spring connector. The body has a central axial bore therethrough for receiving the head end of the connector body. The handle body has a transverse slot formed in its large diameter end face that intersects the axial bore. This transverse slot preferably has a width and bottom shape complementary to an outer shape of a base portion of the loop formed at the head end of the connector. The handle further may have one or more projections from the large diameter base portion extending into its transverse slot to provide an interference lock engaging a portion of the loop to hold the handle in position on the loop. The handle body may further have a straight side portion formed on opposing sides of the body to facilitate a comfortable grip between a user's thumb and forefinger.

An alternative embodiment in accordance with the present disclosure has a similar outer shape, but is designed to be installed on a previously assembled spring assembly that already has a loop formed in at least one of the end connectors. In this alternative embodiment, the handle body again has a generally truncated, preferably concave curved, conical outer shape symmetrical about its central axis, and has an axial bore therethrough and a transverse slot formed in its large diameter end face. This transverse slot intersects the axial bore and has a curved bottom shape complementary to the shape of a base portion of the connector loop. In order to install the handle on the connector of a previously assembled spring assembly, the handle also has an axially extending radial slot through its outer surface extending into the central axial bore. This radial slot is oriented perpendicular to and intersects with the transverse slot in the large diameter base portion of the handle body.

This alternative embodiment is fastened to the loop in the head end of the connector by passing the handle body laterally onto the connector behind the loop and then turning the body 90 degrees to engage the base portion of the loop into the transverse slot. The handle body is then pushed onto the loop until the base portion is fully seated into the transverse slot. These and other features, advantages and objects of the disclosure will become more apparent from a reading of the following detailed description when taken in conjunction with the accompanying drawings.

DETAILED DESCRIPTION OF THE DISCLOSURE

Figure 1:
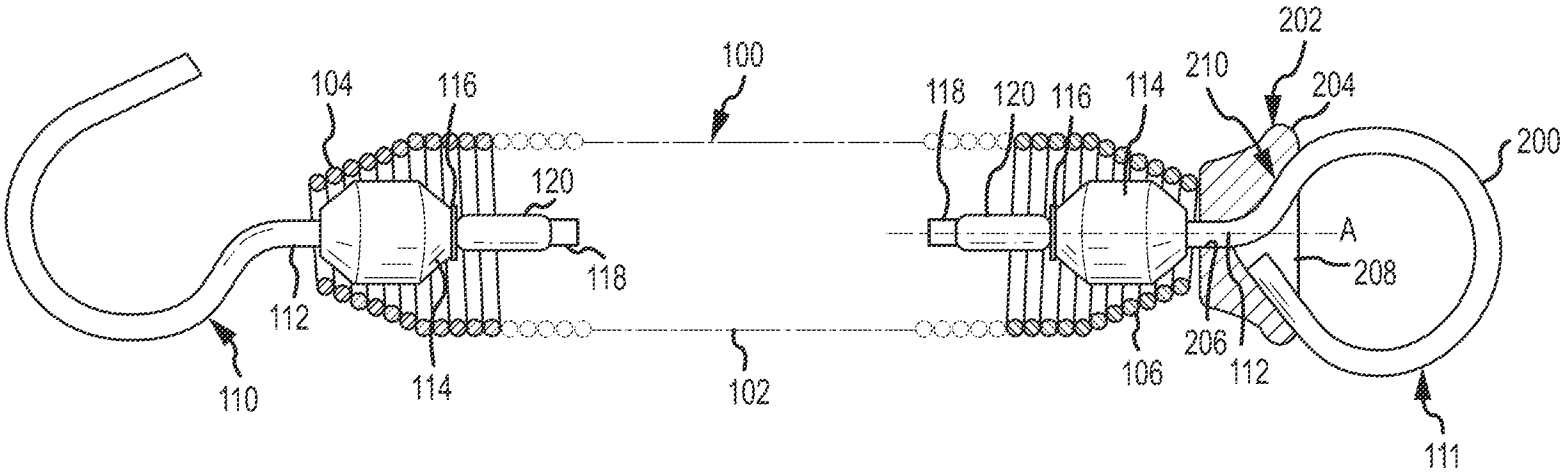
FIG. 1 is a coil spring incorporating a coil spring connector loop handle in accordance with one embodiment of the present disclosure.

A coil spring 100 in accordance with one embodiment of the present disclosure is shown in FIG. 1. The spring 100 has an elongated helical coil spring body 102 terminating at tapered coil end portions 104 and 106. Each end portion 104 and 106 has several coil turns each having a progressively reduced diameter so as to present a frusto-conical outer shape. A connector 110 and 111 in accordance with the present disclosure fits within and extends out of each end portion 104 and 106 respectively.

The connector 110 includes an elongated rod body 112, a polymer stopper body 114 mounted on the rod body 112, and a washer 116, all sequentially disposed on the body 112. The rod body 112 has a crimped flat region 120 adjacent a foot end 118 thereof to lock the stopper body 114 and the washer 116 on the rod body 112 within the tapered end portion 104 of the spring 100. A similar connector 111 is carried at the opposite end portion 106 of the spring 100. However, as shown in FIG. 1, the distal or head end of the elongated rod body 112 in end portion 106 is formed into an eye or loop 200 rather than a hook as in the end portion 104 of the spring 100. The connector 111 in the end portion 106 is substantially identical to that shown in end portion 104 except for the eye shaped free end or loop 200 and a connector loop handle 202 on the rod body 112 which will be described in more detail below.

Each of the stopper bodies 114 has a generally tubular shape with tapered conical end portions 122 and 124. The stopper body 114 is preferably made of The Polymer Company's Nylatron® GS, which is a nylon 6/6 which has a filler of molybdenum disulfide. Other materials may alternatively be used such as DuPont's Delrin®, or other suitable polymer material that is strong, tough, and rigid enough to withstand the spring forces applied.

The washer 116 is preferably a steel washer that abuts the rear tapered portion 124 of the stopper 114 to prevent the crimp 120 from deforming the central bore through the stopper 114 and permitting the stopper to slip off the rear end 118 of the rod 112. Other means for retaining the stopper 114 on the rod 112 may alternatively be utilized instead of the crimp 120. For example, the end 118 may be threaded and a lock nut arrangement installed. Alternatively a cross bore through the end 118 could be provided and a cotter pin installed to hold the washer 116 and stopper 114 in place.

The connectors 110 and 111 are each separately formed and assembled. First a straight rod body 112 is inserted into a machine center and the distal end is shaped into a hook or eye shape. In the case of an eye shape loop 200, next a connector loop handle 202 is inserted onto the foot end of the rod 112 and pushed onto a base portion of the loop 200. Next, the straight foot end of the rod body 112 is inserted into and through a stopper 114 along with a washer 116. Finally the crimp 120 is made in the foot end 118 of the body 112 to complete the assembly of the connector 111.

The spring body 102 is initially formed with only slightly tapered ends 104 and 106. A completed connector 110 is then inserted into end 104 and a completed connector 111 inserted into end 106 of the spring body 102, and then the ends 104 and 106 are compressed to form the final taper configuration as is shown in FIG. 1. This compression completes the assembly of a spring 100 in accordance with the first embodiment of the present disclosure.

The handle body 202 is a solid body which may be made of metal, plastic, rubber, or polymer such as nylon, that has a generally truncated conical exterior shape symmetrical about its central axis A. Preferably the outer surface shape further is a concave truncated cone, with its larger diameter base portion 204 configured to face the connector loop 200 when installed on a spring connector 111. The body 202 has a central axial bore 206 therethrough for receiving the head end of the connector body 112. The handle body 202 has a transverse slot 208 formed in its large diameter base portion 204 that intersects the axial bore 206. This transverse slot 208 preferably has a width and curved bottom shape complementary to an outer shape of a base portion 210 of the loop 200 formed at the head end of the connector 111. Preferably the handle 202 further has one or more projections 212 protruding from the large diameter base portion 204 extending into its transverse slot 208 to provide an interference lock engaging a portion of the loop 200 to hold the handle 202 in position. The handle body 202 may further have a straight side portion on opposing sides of the body to facilitate a comfortable grip between a user's thumb and forefinger.

Figure 2:
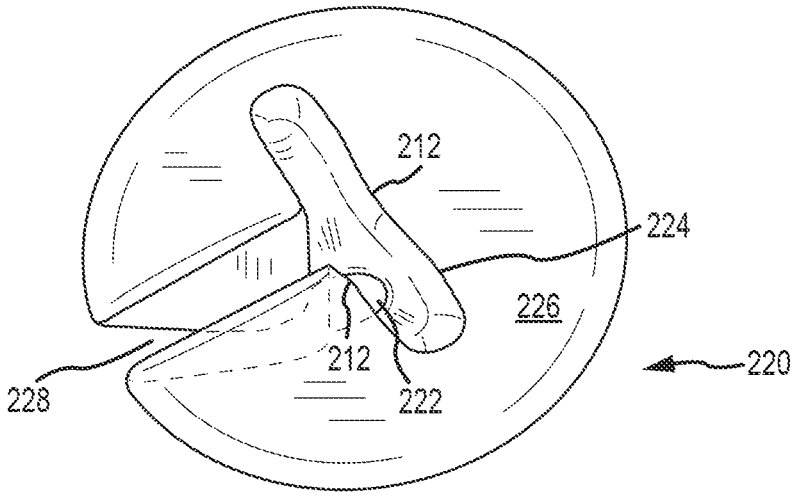
FIG. 2 is a perspective separate view of an alternate connector loop handle in accordance with the present disclosure.

An alternative embodiment 220 of the handle body in accordance with the present disclosure is shown in FIG. 2. This body 220 has a similar outer shape to that of handle body 202, but is designed to be installed on a previously assembled coil spring assembly that already has a loop formed in at least one of the end connectors. In this alternative embodiment 220, the handle body 220 again has a generally truncated, preferably concave curved, conical outer shape symmetrical about its central axis A and has an axial bore 222 therethrough and a transverse slot 224 formed through its large diameter base portion 226. This transverse slot 224 intersects the axial bore 222 and has a curved bottom shape complementary to the shape of a base portion of the connector loop 200. In order to install the handle 220 on the connector of a previously assembled spring assembly, the handle 220 also has an axially extending radial slot 228 through its outer surface extending into the central axial bore 222. This radial slot 228 is oriented perpendicular to and intersects with the transverse slot 224 in the large diameter base portion 226 of the handle body 220.

Figure 3:
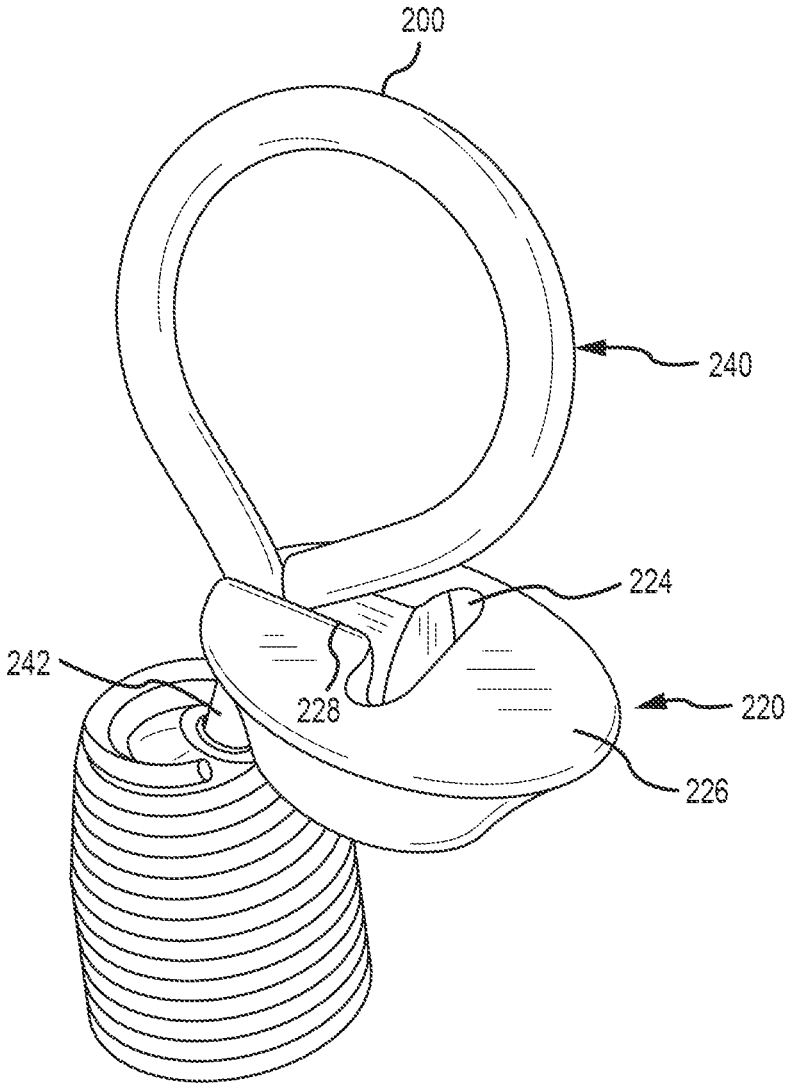
FIG. 3 is a perspective view of a spring loop connector showing the alternate connector loop handle of FIG. 2 being installed onto a stem portion of the loop connector.
Figure 4:
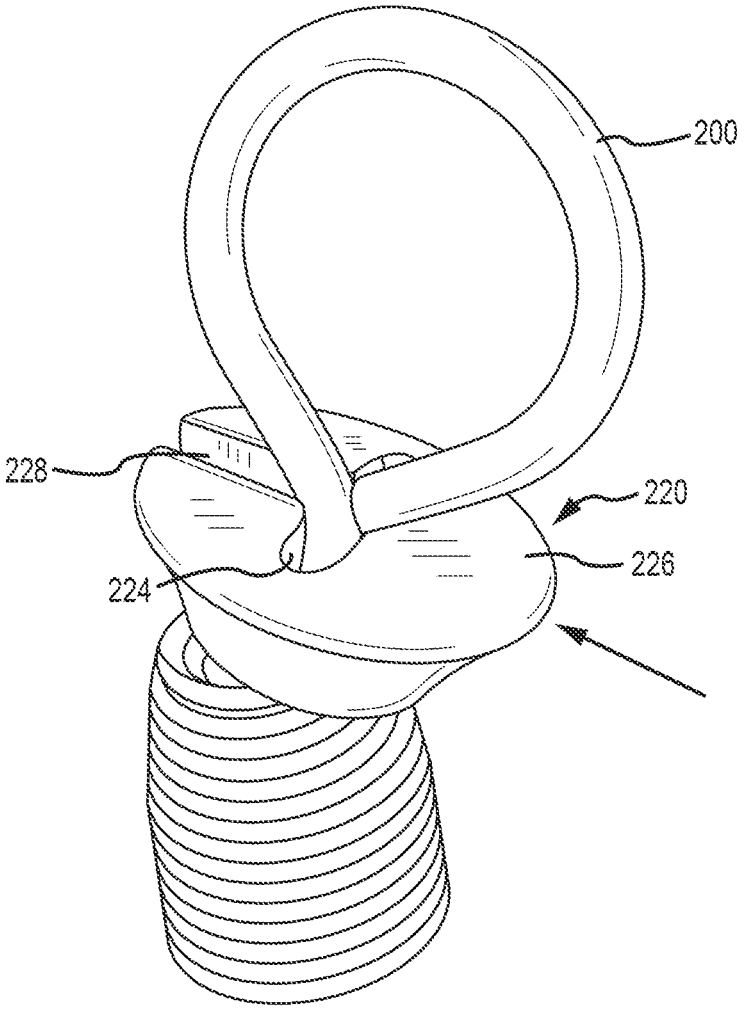
FIG. 4 is a perspective view of the spring loop connector of FIG. 3 with the handle fully inserted into the central axial bore of the handle.
Figure 5:
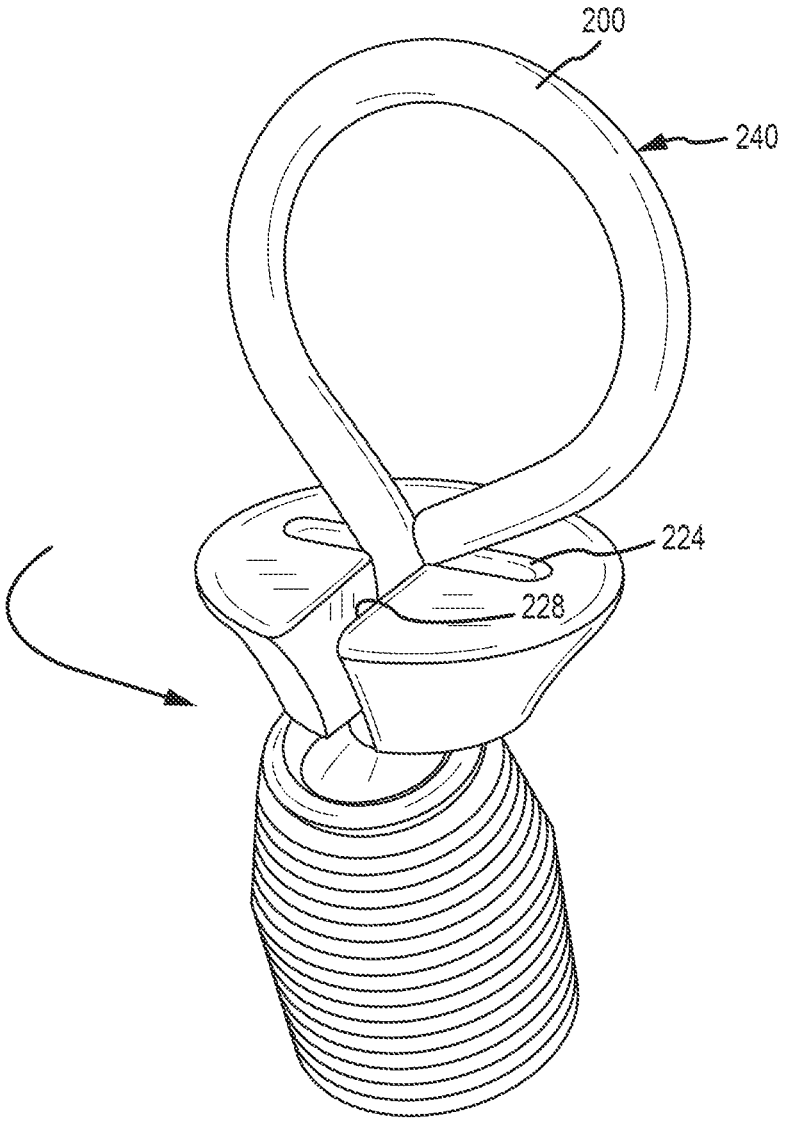
FIG. 5 shows the connector of FIG. 4 with the handle rotated to align the loop with the transverse slot in the handle.
Figure 6:
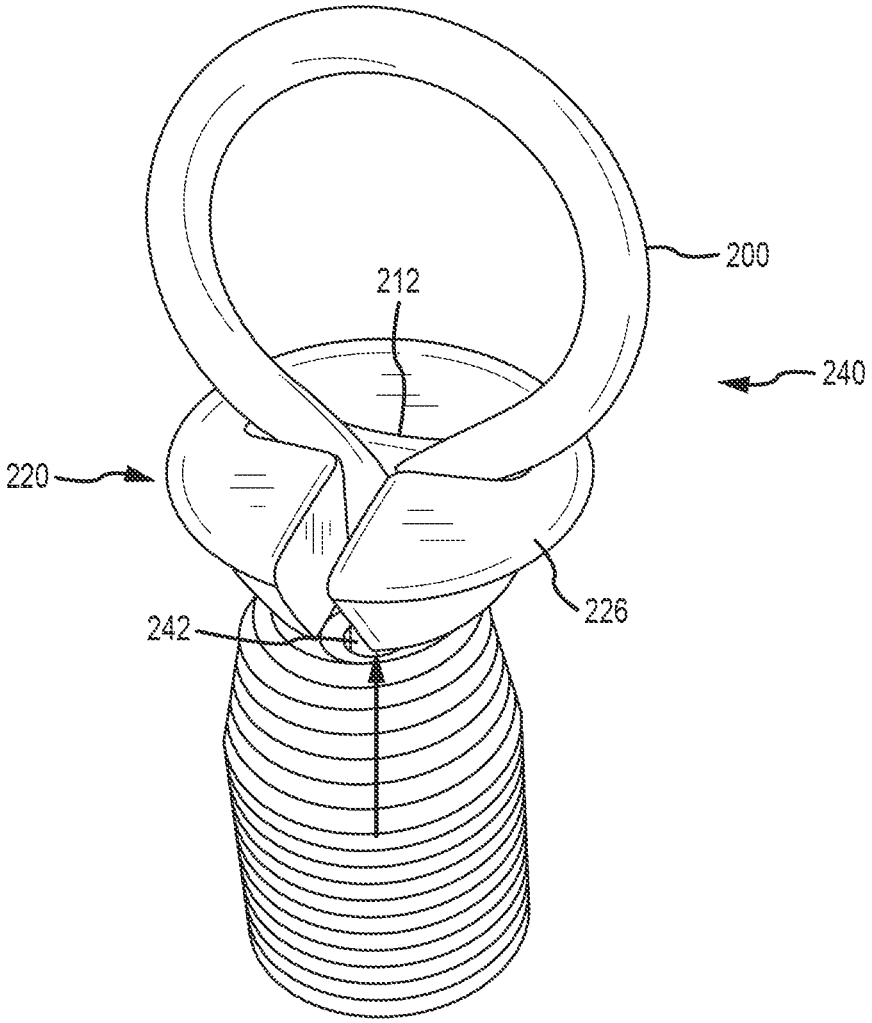
FIG. 6 is a perspective view of the connector of FIG. 5 with the handle fully installed onto the connector loop.

This alternative embodiment is fastened to the loop 200 in the head end of the connector 240 by passing the handle body 220 laterally onto the stem 242 of the connector 240 adjacent the loop 200 as shown in FIG. 3, and by the arrow in FIG. 4, and then turning the body 90 degrees as shown by the arrow in FIG. 5 to engage the base portion of the loop 200 into the transverse slot 224. The handle body 220 is then pushed onto the loop 200 until the base portion of the loop 200 is fully seated into the transverse slot 224 as shown in FIG. 6. The handle 220 preferably includes one or more projections 212 as in the first embodiment 202 described above for engaging the loop 200 to retain the handle 220 on the loop 200 of the connector 240.

It will be clear that embodiments of the present disclosure are well adapted to attain the ends and advantages mentioned as well as those inherent therein. While a presently preferred embodiment has been described for purposes of this disclosure, numerous changes may be made which will readily suggest themselves to those skilled in the art and which are encompassed in the spirit of the disclosure as set forth in the following claims. For example, the external shape of the connector handle 202 and 220 may be other than a truncated conical shape, or may include straight side wall portions to facilitate gripping by a user. Further, the length of the handle may be different than that shown. For example, if the handle is installed during spring assembly, the handle 202 may include a skirt (not shown) that extends over the tapered portion of the spring end 106. Alternatively, the handle 202 may also be molded in place on a preformed loop 200 prior to assembly of the spring 100.

Further, the handle 202 and 220 may be differently shaped to accommodate connectors shaped differently than in a closed loop 200. For example, the connector may terminate in a generally spherical knob, square shape or other structure, that engages with a complementary structure in the exercise apparatus. Accordingly, all such alternatives are encompassed within the spirit and scope of the appended claims.

What is claimed is:

1. A connector handle for installation on a coil spring connector having a loop formed in an end of the coil spring connector attached to one end of a coil spring, the handle comprising:

a polymer body having a truncated cone external shape symmetrical about a central axis, the body having a central axial bore therethrough, a large diameter flat base end and an opposite small diameter end, the base end having an axially extending transverse slot therein intersecting the axial bore through the base end of the polymer body, wherein the transverse slot has opposing side walls spaced from the central axis, closed ends and a concave curved bottom shape, wherein a width of the transverse slot is sized to receive a portion of the coil spring connector loop and the opposite small diameter end is positioned adjacent the one end of the coil spring when the body is installed on the coil spring connector.

2. The connector handle of claim 1 wherein the body has an axially extending radial slot perpendicular to the transverse slot, the radial slot intersecting the axial bore through the body and the transverse slot so as to permit removable installation of the handle onto the coil spring connector via the radial slot.

3. The connector handle of claim 2 wherein an outer side of the body has a curved concave shape extending from the base end to the opposite end.

4. A coil spring connector handle adapted to be installed on an elongated coil spring connector attached to one end of a coil spring, the connector having a circular loop formed at a head end thereof, the handle comprising:

a solid truncated conical body having an external shape symmetrical about a central axis, the body having a central axial bore therethrough for receiving the elongated coil spring connecting member, the body having a large diameter flat base end and an opposite small diameter end, the body having a transverse slot through the large diameter flat base end of the body intersecting the central axial bore, wherein the transverse slot has closed ends at the large diameter flat base end and is sized to receive a portion of the circular loop formed at the head end of the connecting member, the transverse slot having opposing side walls spaced from a central axis of the bore, and the opposite small diameter end is positioned adjacent the one end of the coil spring when the body is installed on the coil spring connector.

5. The connector handle of claim 4 wherein the body has an axially extending radial slot perpendicular to the transverse slot, the radial slot intersecting with the axial bore through the solid body so as to permit removable installation of the handle onto the coil spring connector via the radial slot.

6. The connector handle of claim 5 wherein an outer surface of the body has a curved concave shape extending from the base end to the opposite small diameter end.

7. A coil spring connector handle for use on a spring connector for connecting one end of an elongated coil spring to an object, wherein the connector includes an elongated connecting member having a head end and a foot end, the head end extending out of the one end of the elongated coil spring, the head end having a closed loop shape, the connector having a stopper body within the one end of the coil spring, and a metal washer disc on the connecting member between the stopper body and a crimp section of the connecting member near the foot end of the connecting member, the handle comprising:

a solid truncated circular cone shaped handle body adapted to fit onto the connecting member between the one end of the coil spring and the head end, the handle body engaging and receiving a portion of the loop shaped head end of the connecting member, the handle body having a central axis and an axial bore through which the connecting member extends, a large diameter flat base end and an opposite small diameter end, and a transverse slot through the large diameter flat base end of the handle body intersecting the axial bore for receiving the portion of the loop, the transverse slot having flat side walls spaced from the central axis, closed ends and having a bottom shape complementary to the portion of the loop to be received within the transverse slot, the opposite small diameter end positioned adjacent the one end of the coil spring and the side walls receiving the portion of the loop therebetween when the handle body is installed on the head end of the connecting member.

8. The connector handle of claim 7 wherein the body has an axially extending radial slot perpendicular to the transverse slot, the radial slot intersecting with the axial bore through the solid body so as to permit removable installation of the handle onto the coil spring connector via the radial slot.

9. The connector handle of claim 8 wherein an outer surface of the body has a curved concave shape extending from the base end to the opposite small diameter end of the handle body.

10. A connector handle for installation on a coil spring connector having a loop formed in an end of the coil spring connector attached to one end of a coil spring, the handle comprising:

a polymer body having a truncated curved concave cone external shape symmetrical about a central axis, the body having a central axial bore therethrough, a large diameter flat base end and an opposite small diameter end, the base end having an axially extending transverse slot therein intersecting the axial bore through the base end of the polymer body, wherein the transverse slot has opposing side walls spaced from the central axis, closed ends and a concave curved bottom shape, and the polymer body has an axially extending radial slot perpendicular to the transverse slot, the radial slot intersecting the axial bore through the solid body and the transverse slot, wherein a width of the transverse slot is sized to receive a portion of the coil spring connector loop and the opposite small diameter end is positioned adjacent the one end of the coil spring when the body is installed on the coil spring connector.

* * * * *